United States Patent [19]

Perego

[11] 4,065,175

[45] Dec. 27, 1977

[54] CONVERTIBLE CHAIR

[76] Inventor: Giuseppe Perego, Piazza Martiri Liberta 6, 20043 Arcore, Italy

[21] Appl. No.: 703,055

[22] Filed: July 6, 1976

[51] Int. Cl.[2] ..... A47C 13/00

[52] U.S. Cl. ..... 297/130; 297/345; 297/423

[58] Field of Search ..... 297/326, 344, 13, 335, 297/331, 354, 93, 94, 130, 129, 345, 377

[56] References Cited

U.S. PATENT DOCUMENTS

| | | | |
|---|---|---|---|
| 3,272,556 | 9/1966 | Rocker | 297/377 X |
| 3,351,380 | 11/1967 | Sprague | 297/377 |
| 3,542,419 | 11/1970 | Spinola | 297/345 X |

FOREIGN PATENT DOCUMENTS

| | | | |
|---|---|---|---|
| 1,196,751 | 11/1959 | France | 297/326 |
| 1,429,369 | 1/1966 | France | 297/326 |
| 772,448 | 4/1957 | United Kingdom | 297/326 |

*Primary Examiner*—Francis K. Zugel
*Attorney, Agent, or Firm*—Gust, Irish, Jeffers & Rickert

[57] ABSTRACT

A convertible, multi-purpose, storable child's high chair having a framework for pivotably supporting a one-piece molded seat which has a back wall and two spaced side panels extending upwardly from and contiguous with a seat panel. The framework has a base including two elongate tubular sections, each having a linear center section from which two legs angularly depend. The center sections are transversely spaced by, and affixed to, a cross member. The seat is adjustably and removably connected to a support which is pivoted to the framework center sections, supportable on the cross member in a chair position, and pivotable between the center sections and the angled legs to a stored position. The seat is slidably adjustable on and removable from its support and carries two stands, each stand being formed from an elongate rod. The stands are pivotably supported on the underside of the seat whereby the seat and occupant may be comfortably carried. The stands may be quickly unfastened and unfolded to provide a free-standing chair. A tray and foot board are removably mountable to the seat.

9 Claims, 14 Drawing Figures

FIG.1
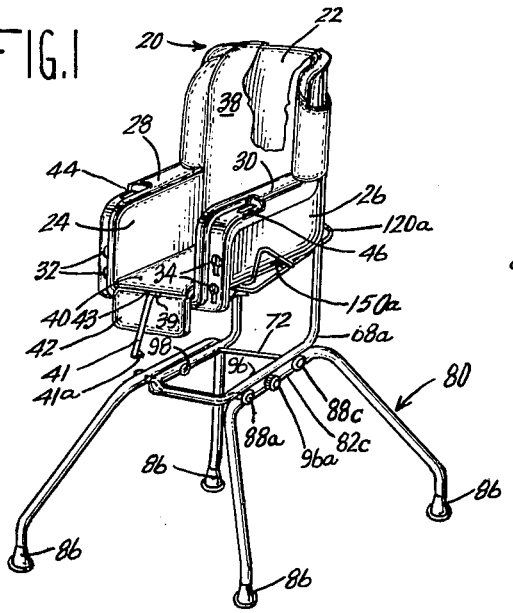
FIG.3
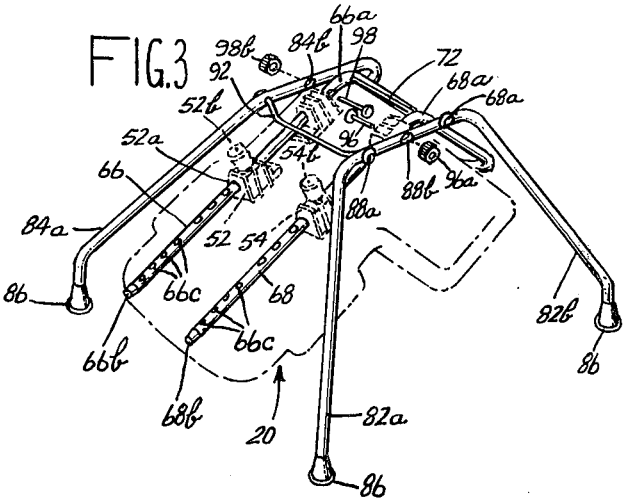
FIG.2
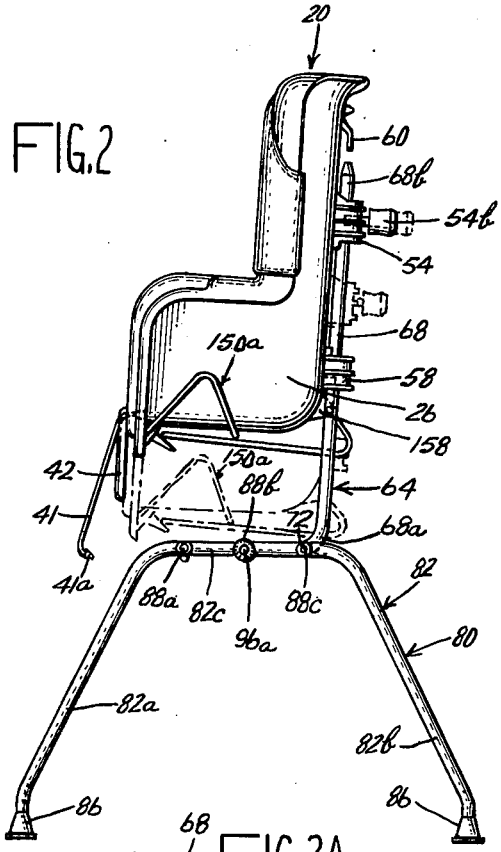
FIG.2A
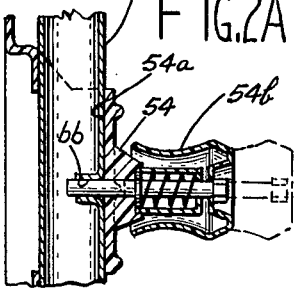
FIG.5
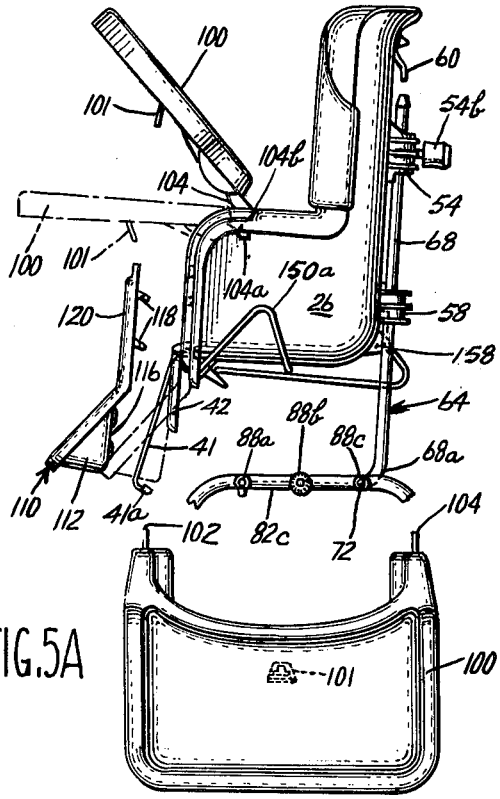
FIG.5A
FIG.5B
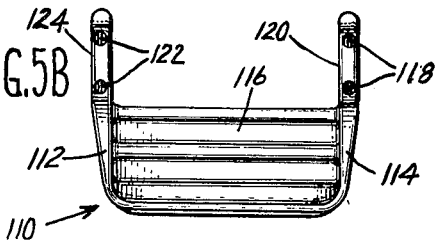

CONVERTIBLE CHAIR

BACKGROUND OF THE INVENTION

1. Field of the Invention

This invention is in the field of convertible, multi-purpose chairs.

2. Brief Description of the Prior Art

Numerous child's high chair designs are in the prior art. High chair design requirements include a stable, safe, and elevated chair support. In addition, due to the bulkiness of such a supported chair, efforts have been made also to provide an articulated chair that can be converted for transport and storage. Further, efforts have been made to adapt the chair construction to multi-purpose uses. These efforts have met with only moderate success due to the contradictory objectives of stability, multi-purpose uses, and articulation. Further, the uses of such chairs have been largely limited due to their secured, supported position.

SUMMARY OF THE INVENTION

A chair having a one-piece molded seat with a back and side panels is adjustably supported on a framework. The seat is slidable and adjustable to a plurality of positions along two connecting parallel elongate tubes. The tubes are pivoted to two spaced parallel center sections of a tubular frame base having four outwardly angled legs, the ends of which engage a supporting surface. The center sections are affixed to and spaced by a cross member which limits the pivotable movement of the parallel tubes in a first position wherein the chair is supported above the cross member in an upright, sitting position. The tubes and chair may be pivoted away from the cross member to a storage position with the seat beneath the cross member and substantially between, and protected by, the legs.

The seat may be removed from the parallel tubes and manually carried. Also, the seat is provided with pivotable stands which may be pivoted against the underside of the seat when carried and may be pivoted outwardly away from the seat bottom to provide a stabilized seat support on, and in close proximity to, a supporting surface.

A tray is removably insertable to the top and front of the side panels and a retaining strap is connected to the front of the seat panel and attachable to the tray. A leg and foot support is attachable to the front ends of the side panels. A seat pad is removably attachable to the seat for covering the back wall and seat portion.

It is an object of this invention to provide a convertible chair that is supported in an adjustably elevated relation to a supporting framework and is articulated thereto so that the chair alternatively may be supported within and protected by the framework.

Another object is to provide a convertible chair of the foregoing object wherein the chair may be removed from the framework and may be carried or, alternatively, supported in free-standing relation to a supporting surface.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

FIG. 1 is a view in perspective, partially broken away, of a preferred embodiment of this invention in the erected position;

FIG. 2 is a side elevational view, having an alternate seat position shown in phantom, of the embodiment of FIG. 1;

FIG. 2A is an enlarged, partial, sectioned view of a plunger mechanism with the outward position shown in phantom;

FIG. 3 is the embodiment of FIG. 1, with the seat portion shown in phantom, in the stored or transport position;

FIG. 5 is a partial side elevational view of the embodiment of FIG. 1 with a tray and a footrest shown prior to installation in the seat, and shown in phantom in the installed positions;

FIG. 5A is a top plan view of the tray shown in FIG. 5;

FIG. 5B is a front elevational view of the footrest shown in FIG. 5;

DESCRIPTION OF THE PREFERRED EMBODIMENT

Figure 8:
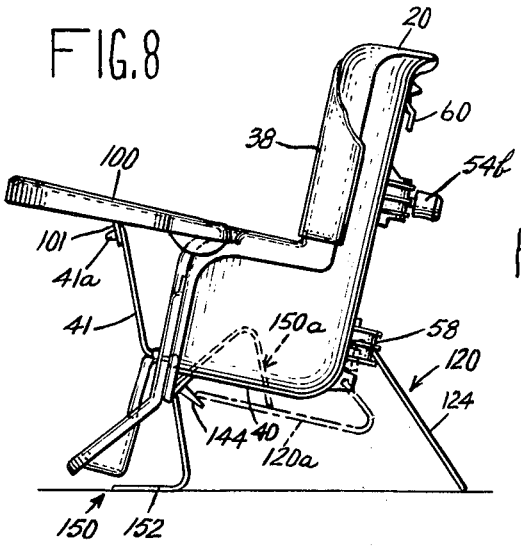
FIG. 8 is a side elevational view of the seat in a free-standing position, with the supporting stands shown in phantom in the folded position.

Referring to the drawings, and in particular FIGS. 1–5, one piece molded seat 20, which may be of a suitable durable plastic material, having rounded corners for safety and structural rigidity, has back wall 22 and side panels 24 and 26. Panels 24 and 26 have formed along the upper edges thereof arm support ledges 28 and 30, respectively. Formed along the front edges of side panels 24, 26 are vertically spaced key slots 32, 34 for purposes to be later described.

Figure 10A:
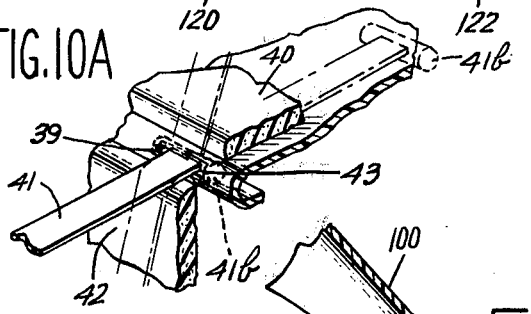
FIG. 10A is a partial sectioned view in perspective of the chair strap mounting.
Figure 10:
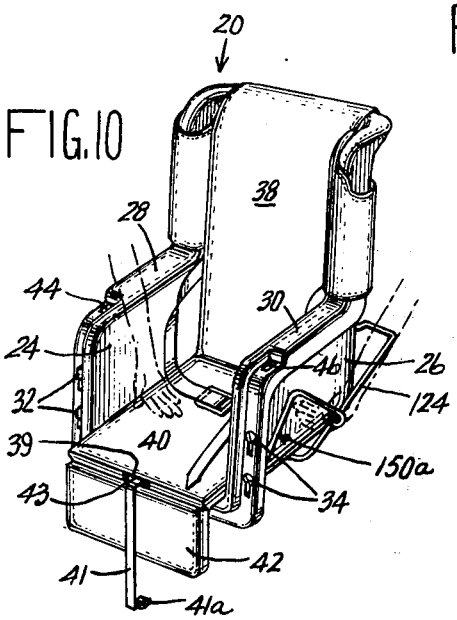
FIG. 10 is a view in perspective of the chair shown in FIG. 8 with the supporting stands in folded position and with hands shown in phantom for carrying the seat in this position.

Fitted over seat 20 is seat pad 38 which covers back wall 22 and which has seat panel 40 with depending flap 42 which is adapted to overly a foot and leg attachment, to be later described. Restraining strap 41 is slidably retained in slot 43 (FIGS. 10 and 10A) in the front edge of panel 40 and extends through a slot 39 in pad 38 for purposes later described. Formed at the forward upward edges of side panels 24 and 26 are slots 44 and 46 respectively to receive tray tabs, later described.

Formed on, and extending from, the rear surface of back wall 22 are a pair of brackets 52 and 54, having elongate cylindrical passages **52*a* and 54*a*, respectively formed therein and spring urged plungers 52b and 54b (FIG. 2A) mounted for transverse movement relative passages 52a and 54a, respectively. Longitudinally aligned with and vertically spaced from each of passages 52a and 54a are brackets 56 and 58, respectively, also formed on the rear surface of back wall 22. Each of brackets 56 and 58 has longitudinal passage 56a and 58a, respectively which are in longitudinal alignment with passages 52a and 54a, respectively. Seat 20 also has a pair of horizontally spaced clips 60 formed adjacent the upper edge of the rear surface of wall 22 which may be used for hanging the seat 20** on hooks or the like.

U-shaped tubular support 64 has a pair of elongate arms 66 and 68 joined by base 70. Arms 66 and 68 have bends 66a and 68a, respectively at corresponding points along the length thereof. The ends of arms 66 and 68 are tapered at 66b and 68b, respectively, to facilitate insertion in openings 52a, 54a, 56a, and 58a, respectively. Arms 66 and 68 are formed with longitudinally spaced transverse holes 66c and 68c respectively. Pivot rod 72 is inserted through holes 66c, 68c at bends 66a and 68a in arms 66 and 68 respectively for pivoting of support 64 in stand 80, as described below.

Stand 80 comprises two elongate base members 82 and 84 each of which has a pair of outwardly angled legs, member 82 having legs 82a and 82b and member 84 having legs 84a and 84b. Each of legs 82a, 82b, 84a, and 84b have caps 86, preferably made of a resilient material having a frictional surface, placed over the ends thereof. Members 82 and 84 have center sections 82c and 84c respectively. Center section 82c has three longitudinally spaced transverse holes 88a, 88b, and 88c formed therein while center section 84c has similarly spaced transverse holes 90a, 90b, and 90c transversely formed therein. The ends of a cross member 92 are inserted in holes 88a and 90a while retaining bolts 96 and 98 are insertable through holes 88b and 90b, respectively. Bolts 96 and 98 also are insertable in corresponding holes 68c and 66c (FIG. 4) in arms 68 and 66, respectively and are secured by nuts 96a and 98a to hold support 64 in the upright position, as shown in FIGS. 1 and 2.

The ends of pivot rod 72 are inserted in holes 88c and 90c and extend therethrough and are fastened thereto with suitable corresponding fastening members. With this construction, support 64 is pivotable about rod 72 between legs 84b and 82b, after bolts 96 and 98 have been removed. The chair is shown in FIG. 3 pivoted to the stored position, legs 82a, 82b, and 84a, 84b protecting and providing the support for the inverted seat 20, shown in dash-dot lines.

Referring now to FIG. 2, support 64 is securely and rigidly supported in its upright position with tapered ends 66b and 68b of arms 66 and 68 in position to be received by the longitudinal openings 52a, 54a, and 56a, 58a, respectively. Seat 20 may then be slid downwardly on arms 66 and 68 with tapered ends 66b and 68b entering longitudinal passages 52a, 54a, and 56a, 58a, respectively. Plungers 52b and 54b are pulled outwardly against their respective spring forces providing an opening through which arms 66 and 68 may be passed, and after seat 20 is in the desired vertical position, plungers 52b and 54b are released and return under their respective spring forces to enter the holes 66c and 68c corresponding to the seat height selected. The seat height may be adjusted by simply exerting an outward pull on plungers 52b and 54b and sliding seat 20 to the desired vertical height, and then releasing the plungers 52b and 54b for engagement with the corresponding holes 66c and 68c in arms 66 and 68.

Figure 6:
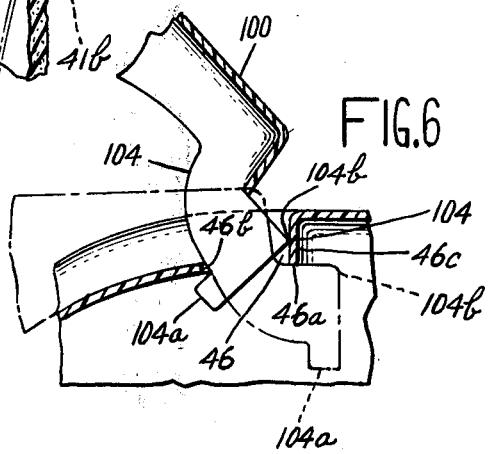
FIG. 6 is a partial enlarged view of the fastening support between the tray and a seat side prior to installation, and shown in phantom in a fully installed position.
Figure 4:
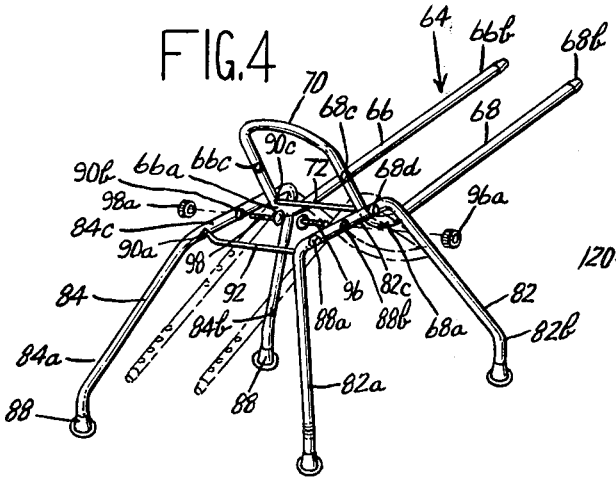
FIG. 4 is the embodiment of FIG. 1 with the seat removed from the support with the support in an intermediate position, and the support shown in phantom in the stored position.

Referring to FIGS. 5, 5A, 5B and 6, tray 100, which preferably is of a molded plastic, has rounded retaining edges for safety and structural rigidity. Tray 100 has formed at each rear corner thereof arcuate extension 102 and 104 which terminate in tabs 102a, 104a, respectively at the ends thereof. Tray 100 may be simply and quickly installed in seat 20 by inserting tabs 102a and 104a in slots 44 and 46, respectively (FIGS. 5 and 6). Tray 100 is then lowered and when corners 102b and 104b on extensions 102 and 104 clear edges 44a, 46a, respectively, and tray 100 may be pivoted downwardly into horizontal position, the arcuate surface of extensions 104 and 102 respectively riding against the edges 44b, 46b causing tray 100 to move rearwardly until it is fully installed in secured position, as shown in the dashed-dot lines in FIGS. 5 and 6. Tray removal may be accomplished by simply lifting upwardly on the tray until tabs 102a and 104a respectively abut edges 46b and 44b (FIG. 6) at which time corners 102b and 104b will have cleared their respective edges 46c and 44c. The tray may then be pivoted downwardly until the tabs 102a and 104a, respectively, clear edges 46b, 44b at which time the tray 100 may be lifted free of the seat 20. Depending from the underside of tray 100 is slotted tab 101 for receiving hook 41a on strap 41 when tray 100 is in the installed position thus serving to hold the occupant in seat 20.

Figure 7:
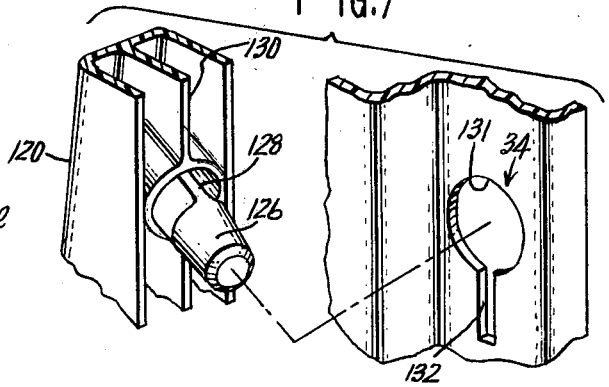
FIG. 7 is an enlarged partial exploded view of the connecting members for the footrest and the seat front edge.

Referring to FIGS. 5, 5B, and 7, one-piece molded plastic leg and foot support 110 has rounded edges for safety and structural rigidity. Sidewalls 112, 114 serve to contain the feet of the seated child and rear wall 116 restrains the feet from movement under seat 20. Tapered plugs 118 are formed in vertically spaced relation along edges 120, 122 and extend rearwardly therefrom. Each plug 118 and 122 is comprised of a tapered, conical portion 126 (FIG. 7) supported by a flange section 128 which extends from and is a part of center rib 130 of the respective edge 120, 122. Portions 126 register with the circular openings 131 in their respective key holes 32 and 34 and are insertable therethrough until flange sections 128 become aligned with longitudinal slots 132 which depend from openings 131 in each of holes 32 and 34. At this point, the support 110 may be lowered causing sliding of flanges 128 in slots 132 to lock support 110 in place on the seat 20. Support 110 may be easily removed by lifting until sections 126 again become aligned with the circular openings 131 in holes 32 and 34 and withdrawing the plugs through the openings for disassembly.

For storage, seat 20 is moved to its lowermost position on arms 66 and 68 and bolts 96 and 98 are removed. Support 64 is then swung clockwise (FIG. 2) until the seat 20 is inverted in the position of FIG. 3. At this point, the seat is protected by the outwardly extending legs 82a, 82b, 84a, 84b and supported thereby in spaced relation to the supporting surface. Thusly converted, the seat may be transported easily, as in the trunk of an automobile, and/or stored.

The seat 20 may be removed from the support 64 by pulling plungers 52 and 54 and sliding seat 20 upwardly until removed from arms 66 and 68. Rear stand 120 (FIGS. 8 and 9) is formed of a closed loop having base 122 and legs 124 and 126 extending inwardly from the base 122. Legs 124 and 126 are bent intermediately thereof to form segments 128 and 130 which are joined by pivot rod 132. Bracket 134 extends from the lower edge of the rear surface 23 of back wall 22 and has an elongated opening therein for receiving and pivotably supporting rod 132. Flanges 136 on either side of bracket 134 also are provided with openings for pivotably supporting rod 132. Clips 140 and 142 are also formed on and extend from rear surface 23 and have elongated slots 140*a* and 142*a* for receiving and resiliently clamping segments 128 and 130 respectively, thus providing a rear support for seat 20 when used as a free-standing feeding chair.

Front stand 150 has legs 152 with pivot sections which are pivotably housed in horizontally spaced brackets which are along the underside of the forward edge of panel 40. Thus, stand 150, when pivoted clockwise (FIG. 8) provides a forward support when the seat is used in its free-standing position.

Seat 20 may also be used as a carrier and in this mode, stand 150 is pivoted counterclockwise to the position 150*a* (FIGS. 8 and 10), and stand 120 is disengaged from clamps 140 and 142 and pivoted clockwise to the dashed-line position 120*a* until base 122 engages and displaces the end of resilient tab 144 which extends from the underside of the forward edge of panel 40. In this position, stand 120 engages and retains stand 150 in its retracted position so that seat 20 and its occupant may be carried with the stands 120 and 150 safely and securely held in retracted position against the bottom of seat 20.

Figure 9:
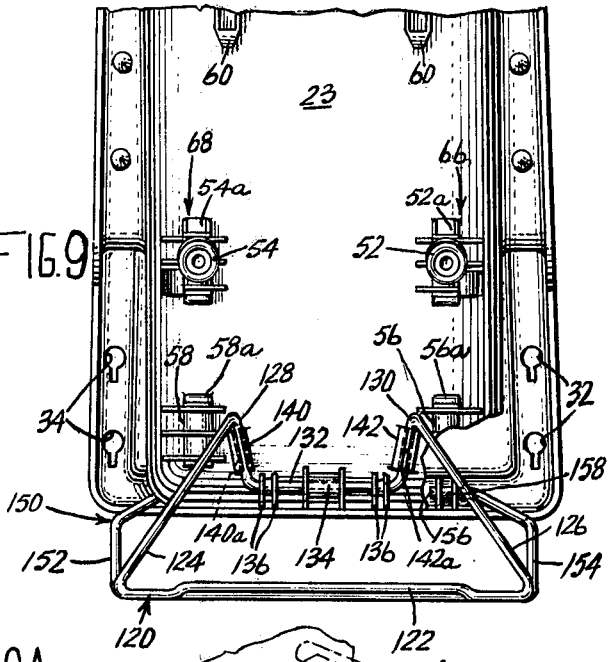
FIG. 9 is an enlarged partial elevational view of the rear side of the seat in FIG. 8.

Thus, the chair of this invention is convertible into four positions: first, as an adjustable high chair as shown in FIGS. 1, 2 and 5, FIG. 5 showing the optional tray and leg support being attached; second, the chair of FIG. 1 may be pivoted, after removing bolts 96 and 98, to an inverted position wherein legs 82*a*, 82*b*, 84*a* and 84*b* provide protection and support for transport or storage; third, as a free-standing chair shown in FIGS. 8 and 9; and fourth, as a carrier with stands 150 and 120 folded under the chair and held in position by tab 144.

While there have been described above the principles of this invention in connection with specific apparatus, it is to be clearly understood that this description is made only by way of example and not as a limitation to the scope of the invention.

I claim:

1. A convertible chair comprising:

a framework comprising a plurality of elongate legs connected at their upper ends and disposed in outwardly angled configuration in relation to one another, the lower ends of said legs being engageable with a supporting surface;

a chair mounted in pivotable relation to said framework and swingable to a first upright position for occupant seating support relative said framework and to a second inverted position between two of said legs whereby said chair is disposed substantially between said legs;

releasable means for releasably securing said chair to said framework in said first position; and adjusting means for vertically adjusting said chair relative said framework when said chair is in said first position.

2. A device according to claim 1 wherein two of said legs are formed from a first elongate member having a center linear portion and the other two of said legs are formed from a second elongate member having a center linear portion in transversely spaced parallel relation to said linear portion of said first member;

said chair being pivoted to each of said center portions at transversely spaced pivot points;

a transverse member secured at each end to said center linear portions and spaced from said pivot points to fix said elongate members relative one another;

said chair supportable on the upper surface of said transverse member in said upright position and an unobstructed swing path being formed between said legs to provide seat swinging away from said upper surface about said pivot points through said path to said inverted position.

3. A device according to claim 2 wherein said adjusting means comprises a chair support pivotably connected to said center linear portions for supported contact with said transverse member in said first position and swingable away from said transverse member to said second position for storing;

said support in said first position having at least one upwardly extending portion; and said chair being adjustably supportable on said portion at a plurality of vertically spaced positions.

4. A device according to claim 3 wherein said chair is removably connected to said support;

a pair of supporting stands each of which is pivotably mounted to said seat and swingable clear of the other of said stands to a first position after said seat is removed from said portion to support said chair on a supporting surface, and swingable to a second, stored position beneath said chair, one of said stands engaging the other of said stands in said second position; and a securing member to releasably hold said one of said stands when in said second position against the bottom surface of said seat thereby holding both of said stands in said second position.

5. A device according to claim 1 wherein:

said seat has a seat panel; a back wall and two spaced side panels upstanding from said seat panel and contiguous therewith to provide a back support and arm supports respectively;

a tray member being removably attachable to said side panels and supportable in a relatively horizontal position spaced vertically from said seat panel when said seat is in said first position to provide a leg opening between said tray and said seat panel; and an elongate strap member attached at one end to the seat panel and attachable at its other end to said tray to define two leg openings and to provide containment of the seat occupant.

6. A device according to claim 1 including a support removably attachable to and depending from said seat to provide leg and foot support to the seat occupant.

7. A device according to claim 3 wherein said upwardly extending portion comprises a pair of parallel elongate transversely spaced arms; each of said arms having longitudinally spaced apertures therein; said seat having formed thereon a pair of transversely spaced protrusions each having a longitudinal opening therein for receiving said arms; a spring operated plunger mounted in each of said protrusions; said plungers being registrable with said apertures in said arms to adjustably support said seat on said arms.

8. A convertible chair comprising: a chair a framework comprising a plurality of elongate legs connected at their upper ends with their lower ends being engageable with a supporting surface; a chair support connected to said framework and having at least one elongate upwardly extending member having an upper end;

a slide means securely attached to said chair and slidably engaged with said member for adjustably supporting said chair on said member at a plurality of upwardly spaced positions;

said means and chair being slidably removable from the upper end of said member; said chair support being pivotably connected to said framework and swingable to a first position for upright chair support and to a second inverted position whereby the chair is disposed substantially within said framework.

9. The apparatus of claim 8 having a pair of elongate upwardly extending members connected to said framework in transversely spaced relation;

each of said members having longitudinally spaced apertures therein;

said means attached to said chair comprising a pair of transversely spaced protrusions; one protrusion having a longitudinal opening therein for receiving one of said members and the other of said protrusions having a longitudinal opening therein for receiving the other of said members;

a spring biased plunger being mounted in each of said protrusions; said plungers being registrable with said apertures in their respective members to adjustably support said chair on said members.

* * * * *